US010920373B2

(12) United States Patent
Jaschinski et al.

(10) Patent No.: US 10,920,373 B2
(45) Date of Patent: Feb. 16, 2021

(54) METHOD FOR OPERATING A MACHINE FOR PRODUCING A FIBROUS WEB AND MACHINE FOR PRODUCING A FIBROUS WEB

(71) Applicant: VOITH PATENT GMBH, Heidenheim (DE)

(72) Inventors: Thomas Jaschinski, Heidenheim (DE); Robert Attwenger, Vienna (AT); Guilherme Custodio De Araujo, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 25 days.

(21) Appl. No.: 16/343,051

(22) PCT Filed: Sep. 27, 2017

(86) PCT No.: PCT/EP2017/074429
§ 371 (c)(1),
(2) Date: Apr. 18, 2019

(87) PCT Pub. No.: WO2018/077558
PCT Pub. Date: May 3, 2018

(65) Prior Publication Data

US 2020/0048835 A1 Feb. 13, 2020

(30) Foreign Application Priority Data

Oct. 28, 2016 (DE) ..... 10 2016 120 647

(51) Int. Cl.
*D21F 1/48* (2006.01)

(52) U.S. Cl.
CPC ..... *D21F 1/486* (2013.01)

(58) Field of Classification Search
USPC ..... 162/202
See application file for complete search history.

(56) References Cited

U.S. PATENT DOCUMENTS

2002/0060040 A1* 5/2002 Rulis ..... D21F 1/486 162/352
2009/0301677 A1* 12/2009 Cabrera Y Lopez Caram ..... D21F 1/483 162/202

FOREIGN PATENT DOCUMENTS

EP 1063348 A2 12/2000

* cited by examiner

*Primary Examiner* — Mark Halpern
(74) *Attorney, Agent, or Firm* — Laurence A. Greenberg; Werner H. Stemer; Ralph E. Locher

(57) ABSTRACT

A method of operating a machine for producing a fibrous web. The machine has a de-watering device with a plurality of pivotally embodied de-watering strips. In the method, an inclination angle of at least one of the de-watering strips is modified as a function of at least one parameter. The modification is effected by way of the pivoting installation which is activated by a control installation. The actual inclination angle of the at least one de-watering strip to be pivoted is detected and transmitted to the control installation. The control installation activates the pivoting installation as a function of the transmitted inclination angle.

13 Claims, 3 Drawing Sheets

METHOD FOR OPERATING A MACHINE FOR PRODUCING A FIBROUS WEB AND MACHINE FOR PRODUCING A FIBROUS WEB

This application is a 371 of PCT/EP2017/074429 filed 27 Sep. 2017

BACKGROUND OF THE INVENTION

Field of the Invention

The present invention relates to a method for operating a machine for producing a fibrous web, in particular a paper, cardboard, or packaging paper web, from at least one fibrous suspension, comprising a de-watering device having a plurality of pivotably embodied de-watering strips, in detail as claimed in the independent claim.

Machines of this type have de-watering devices, also referred to as de-watering boxes. Said de-watering devices serve for supporting a continuous revolving screen on which the fibrous web is formed from the fibrous suspension that continuously flows onto the screen. When viewed in the running direction of the fibrous web to be produced, the de-watering device has a plurality of de-watering strips which are disposed beside one another so as to be laterally spaced apart. The screen herein, by way of the lower side thereof, wipes the upper side of the upper part of the de-watering strips. The upper part faces the screen and typically has a wearing part which is connected to the upper part. The wearing part in most instances has a scraper-like leading-edge. The latter additionally serves for discharging the screen water which from the fibrous web being formed has flowed through the meshes of the screen and adheres to the lower side of the screen. Individual or all de-watering strips are embodied so as to be pivotable, in order to be able to adapt the de-watering strip to the produced paper type as a function of the inclination angle.

In paper machines in which the operating conditions often change (for example, change of the paper type, modified screen speed or machine speed, etc.), a modification of the mentioned inclination angle at the de-watering strips is often required. On account thereof, the de-watering distance and thus the de-watering rate are adapted to the fibrous web to be produced. In the case of the de-watering devices known from the prior art to date, an adjustment of the inclination angle is indeed possible. However, there are two disadvantages. In the case of a change of the paper type, the inclination angles of all de-watering strips have to be modified, on the one hand. This is performed manually, for example. On the other hand, said de-watering devices do not have any exact inclination angle display such that the actually set inclination angles have to be read in a tedious and indirect manner at the individual de-watering strips, for example by way of the length of a spindle of the pivot drive. In the running operation of the machine, this is a problematic undertaking which by virtue of the high operating speed of the machine (also referred to as the machine speed) is also dangerous. Moreover, disturbance variables which require a modification of the inclination angle in the running operation of the machine often arise in the operation. Such disturbance variables are, for example, a dry content of the produced fibrous web which is actually established in the operation and is modified in relation to an initial parameter.

SUMMARY OF THE INVENTION

The invention relates to the subject matter mentioned at the outset.

The invention is based on the object of avoiding the disadvantages of the prior art. Rather, a reliable display of the actually set inclination angle of the de-watering strips and a modification of the inclination angle during the operation are to be possible, so as to be able to react to modified operating parameters of the machine.

The object is achieved by the independent claims. Particularly advantageous and preferred embodiments are illustrated in the dependent claims.

According to the present invention, the inclination angle of the pivotably embodied de-watering strips of the de-watering device is thus controlled in a closed-loop manner, and thus the de-watering rate of said de-watering device. A closed-loop control circuit in which the actual current inclination angle of the respective de-watering strip to be controlled in a closed-loop manner, or of all de-watering strips, respectively, is fed back to the control installation which functions as a closed-loop controller is thus present. In the context of this closed-loop control, the setpoint value for the inclination angle represents the command variable or correcting variable for the pivoting installation (presently also referred to as the input variable), the actual value for the inclination angle represents the control variable, and the system deviation from said input variable and said control variable represents the control deviation for the closed-loop control by means of the control installation.

The term inclination angle in the context of the present invention is understood to be an angle which indicates the gradient of the de-watering strip in relation to a horizontal plane. This specifically means the angle which the upper side, preferably that of the upper part, of the de-watering strip which faces the lower side of the screen revolving in relation thereto encloses conjointly with the horizontal plane. The inclination angle can be determined as a gradient angle in % or else in degrees. Said inclination angle thus indicates the relative positional modification of the de-watering strip, or of the upper part of the de-watering strip, respectively, in relation to the horizontal (or the horizontal plane).

The de-watering strip can be constructed from an upper part and a lower part, wherein the lower part is connected in a stationary manner, thus fixedly, to a main body of the de-watering device. The upper part in this instance is pivotable in a relative manner about a rotation axis which runs parallel to the longitudinal axis of the de-watering strip. For example, the longitudinal axis can correspond to the width direction of the fibrous web, or of the screen, respectively. The rotation axis thus runs so as to be substantially parallel to the plane which is defined by the screen, or by the fibrous web, respectively, when sweeping the de-watering strip. Substantially herein this means that a deviation by 10°, preferably by 20°, to either side is possible. The inclination angle thus results on account of the pivoting movement about the mentioned rotation axis of the upper part relative to the lower part, or to the main body of the de-watering device, respectively. The position of said rotation axis can also be non-stationary, that is to say that the rotation axis per se can pivot as a consequence of the upper part. On account of the corresponding pivoting movement it can be achieved that the front edge of the upper part remains in the screen plane.

In terms of a Cartesian coordinate system in which the fibrous web, and the screen, respectively, run in a X-Y plane, the width direction of the fibrous web, or of the screen, respectively, can be the x-direction, and the running direction of the fibrous web to be produced, or of the screen, respectively, can be the positive y-direction. As a result, the thickness direction of the fibrous web, or of the screen, respectively, in this instance is the z-direction (vertical direction). The stationary lower part of the de-watering strip in this instance are situated in the X-Y plane. Proceeding from this definition, the inclination angle according to the invention can be understood to be that angle that results on account of the rotation about the X-axis of the upper part relative to the lower part. However, the inclination angle could also describe a corresponding rotation of the de-watering strip, or the upper part thereof, respectively, about one or a plurality of the mentioned axes (x-axis, y-axis, z-axis) relative to the horizontal plane. This will be explained hereunder with reference to the inclination sensor.

The inclination sensor, the control installation, or the display installation, respectively, can be specified in such a manner that the actual (current) inclination angle of the pivotably embodied de-watering strip(s) is ascertained or displayed, for example, in degrees as an absolute value or as a relative value in relation to a horizontal plane or on the main body. The inclination angle can be present as an electric signal. In principle, it would be conceivable for the inclination sensor to be specified in such a manner that said inclination sensor detects not only one-dimensional angles, thus the rotation only about one of the three axes (x-axis, y-axis, z-axis) in the above example, but multi-dimensional angles. In the last-mentioned case, the inclination sensor would thus be a position sensor and could thus detect a combination of a plurality of inclination angles simultaneously about a plurality of the three axes (x-axis, y-axis, z-axis). A detection in at least two axes, for example the x-axis and the y-axis, has the advantage that in the installation of the de-watering strips on the main body of the de-watering device the measured values of the inclination sensors equally enable a horizontal alignment along the x-axis, since unintentional deviations about the y-axis are immediately detected by said inclination sensors. It can thus also be checked whether the entire de-watering device having the de-watering strips is correctly aligned.

Each de-watering strip herein can be assigned a respective pivoting installation and an inclination sensor. Both can be accommodated within the respective de-watering strip, preferably encapsulated in relation to the ingress of media from the outside.

The pivoting installation can be embodied in such a manner that the upper part of the de-watering strip is pivotable relative to the lower part (or the horizontal plane, respectively) by at least 10°, preferably by at least 20°.

A control installation according to the invention can in this instance be assigned collectively to all pivoting installations of the pivotably embodied de-watering strips. The individual pivoting installations as well as the inclination sensors of the pivotably embodied de-watering strips can be connected to the control installation by way of respective communication channels.

When mention of a communication channel according to the invention is made, this thus means an installation for the transmission of information, for example by means of an electric signal. Installations of this type can be present in the form of wire-bound lines as well as in the form of wireless communication installations (radio frequency). It is also conceivable that the signal emanating from the at least one inclination sensor is transmitted to a mobile terminal such as a smart phone, a tablet PC, or similar.

A de-watering strip according to the invention is usually longer than the width of the fibrous web to be produced.

The term "at most" in relation to a minimum value or maximum value according to the invention means that the value is 0 or greater than 0, but at most comprises the value (minimum value or maximum value) according to the invention. For example, when mention is made of "at most 150%", this thus means the interval between (including and greater than) 0% and (including or exactly) 150%.

A fibrous web in the context of the invention is to be understood as a cross-laid structure or a random-laid structure, respectively, of fibers such as cellulose, man-made fibers, glass fibers, carbon fibers, admixtures, additives, or the like. The fibrous web can thus be configured as a paper, cardboard, or tissue web, for example. Said fibrous web can substantially comprise wood fibers, wherein minor quantities of other fibers or else admixtures and additives can be present. Depending on the specific application, this is left to the person skilled in the art.

The type of a fibrous web refers to the property of the fibrous web in terms of the composition, the production, and the form of appearance and use thereof. When the fibrous web is paper, then a paper type is to be understood, for example, as coated paper, copy paper, label paper, etc.

The term intended use is understood to be that state of the machine in which the desired fibrous web is produced from the fibrous suspension and is further processed on the machine. In detail, this screen of the screen section in this state moves relative to the de-watering device and continuously past the latter, the fibrous suspension makes its way onto the screen, and the excess water for de-watering is discharged through the de-watering slots. By contrast, such a production of the fibrous web is not possible in a non-operating state of the machine, thus in the case of taking said machine out of operation, for example for the purpose of maintenance.

The start of the operation refers to that temporal point at which the machine is ready for actually producing the fibrous web. In this state, the machine has been set up for the fibrous web and is ready for directly assuming the intended operation.

A constant value is to be understood as a property of the fibrous web to be produced or of the machine per se, which is present prior to the start of the operation or is theoretically assumed for the production of the fibrous web. A property of the fibrous web can be the raw material from which said fibrous web is produced, the chemicals which said fibrous web comprises, or the type of said chemicals. A property of the machine can be the construction mode thereof in terms of the form of de-watering such as fourdrinier machine or a hybrid former, the equipment features thereof such as the number and type of screens and rollers or the calculated theoretical machine speed thereof that is required for producing the fibrous web. The constant value is a parameter which is predefined at the start of the operation of the machine. Said constant value is therefore assumed to be constant as it is presumed that said constant value is not modified during the operation of the machine.

The term method parameter refers to a parameter which is measured (directly detected) or determined (indirectly, for example ascertained by calculation) during the (intended) operation of the machine and which describes the current property of the fibrous suspension, of the currently produced fibrous web, or an actual, established variable of the machine. Such a method parameter can be, for example: the current machine speed or screen speed, respectively, the required energy, for example electrical energy, or a variable associated therewith such as the output, the fresh water requirement of the machine measured in liters per hour, a visual or physical property of the fibrous web just produced, such as the formation result thereof (size distribution and anisotropy of spots in the transparent review, the periodicity of re-occurring features), area weight, fabric density or the dry content thereof, also correspondingly in terms of single-tier or multi-tier fibrous webs. The method parameter is thus subject to modifications in the operation of the machine during the production process.

Both the constant value as well as the method parameter represent at least one parameter in the context of the present invention, the closed-loop control of the inclination angle of the pivotably embodied de-watering strips being performed based on said parameter. In principle, closed-loop controlling can be performed simultaneously based on both parameters. Nevertheless, it would also be conceivable that such closed-loop controlling of the inclination angle during the operation is also performed in a temporally separate manner, in each case by way of one and then by way of another parameter. According to one embodiment it would thus be conceivable for the inclination angle to be pre-set (rough closed-loop control, external control circuit) at the start of the operation so as to correspond to the constant value, and for the inclination angle after the start of the operation, thus during the operation, then to be closed-loop controlled as a function of a method parameter (fine closed-loop control, internal control circuit).

When mention is made that items of information are stored in the control installation, said items of information in this instance can be stored in a memory assigned to the control installation. In this way, it is thus possible for items of information, for example in the form of databases, tables, characteristic curves or characteristic diagrams, to be stored in the control installation, pertaining to which items of information belong to which type of the fibrous web to be produced. For each fibrous web type that is producible by the machine a corresponding data set having the constant values required therefore can thus be stored. For example, proceeding from a constant value which characterizes the fibrous web to be produced, a setpoint value for the inclination angle to be set at the start of the operation of the machine, also referred to as a reference value, can be calculated by the control installation, for example.

In principle, it is conceivable for the rough closed-loop control or fine closed-loop control to be capable of being influenced by a manual parameter. It would thus be possible for a corresponding setpoint value to be predefined for the rough closed-loop control or fine closed-loop control. Such a parameter can be preferably wirelessly transmitted by means of a mobile terminal such as a smartphone, a tablet PC, or similar to the control installation by way of a corresponding communication channel. In principle, it is also possible for the rough closed-loop control or fine closed-loop control of the inclination angle to be overridden by means of the mobile terminal, that is to say for said rough closed-group controlling or fine closed-group controlling to be overruled and for the corresponding inclination angle to be set, also separately for each individual de-watering strip, by means of said terminal. To this end, the invention also relates to the use of an above-mentioned mobile terminal for setting the inclination angle of at least one de-watering strip of a de-watering device according to the invention.

The memory can be part of the control installation per se. The control installation in turn can be part of the control panel of the machine.

The control installation can furthermore comprise a processing unit such as a microprocessor, so as to determine the system deviation from the nominal value and the actual value and so as to therefrom be able to calculate a corresponding input variable for the pivoting installation.

The invention also relates to a machine for producing a fibrous web, in particular a paper, cardboard, or packaging paper web, from at least one fibrous suspension, said machine comprising a de-watering device having a plurality of pivotably embodied de-watering strips, at least one pivoting installation that is assigned to the pivotably embodied de-watering strip, and a control installation, wherein the control installation is specified in such a manner that said control installation carries out the method according to the invention.

The invention furthermore also relates to the de-watering device according to the invention and to a screen section comprising such a de-watering device.

The invention finally also relates to a system from at least one pivotably embodied de-watering strip, at least one inclination sensor assigned to said de-watering strip, at least one pivoting installation assigned to said de-watering strip and a control installation which by way of respective communication channels is connected to the inclination sensor, on the one hand, and to the pivoting installation, on the other hand, and is preferably specified in such a manner that said control installation carries out a method according to the invention.

BRIEF DESCRIPTION OF THE SEVERAL VIEWS OF THE DRAWING

The invention is to be explained now in an exemplary manner by means of the figures in which.

DESCRIPTION OF THE INVENTION

Figure 1:
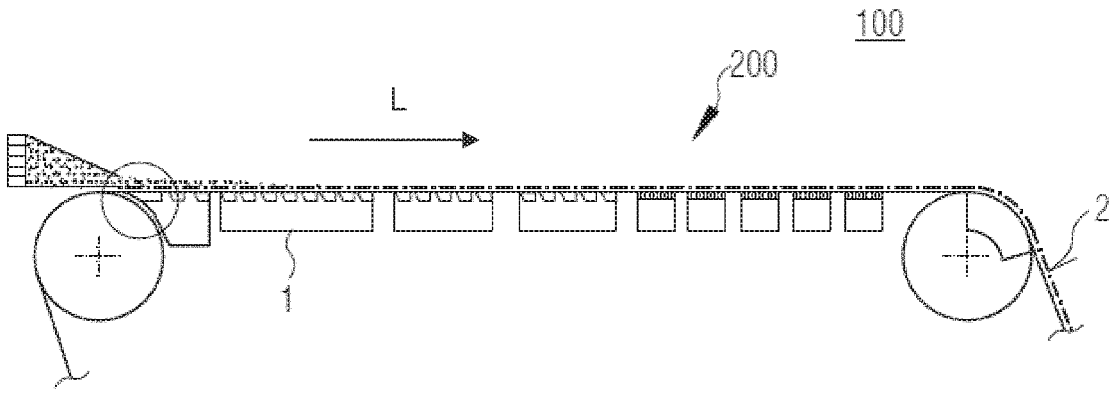
FIG. 1 shows a schematic, partially sectional, longitudinal illustration of a screen section of a machine for producing a fibrous web, said machine being illustrated only in fragments.

FIG. 1 shows a schematic, partially sectional, longitudinal illustration of a screen section 200 of a machine 100 illustrated only in fragments for producing a fibrous web 2 from at least one fibrous suspension. The machine direction L here runs from left to right. The fibrous web 2 can in particular be a paper, cardboard, or packaging paper web. The fibrous suspension makes its way from a headbox onto a screen which is embodied as a continuous belt and which revolves relative to the de-watering device 1. The fibers deposited on the upper side of the screen are transported onward conjointly with said screen. The excess water of the fibrous suspension makes its way into the de-watering device 1 by way of the lower side of the screen. The fibrous web 2 thus formed on the upper side of the screen is transported onward to the next processing station by way of said screen.

Figure 2:
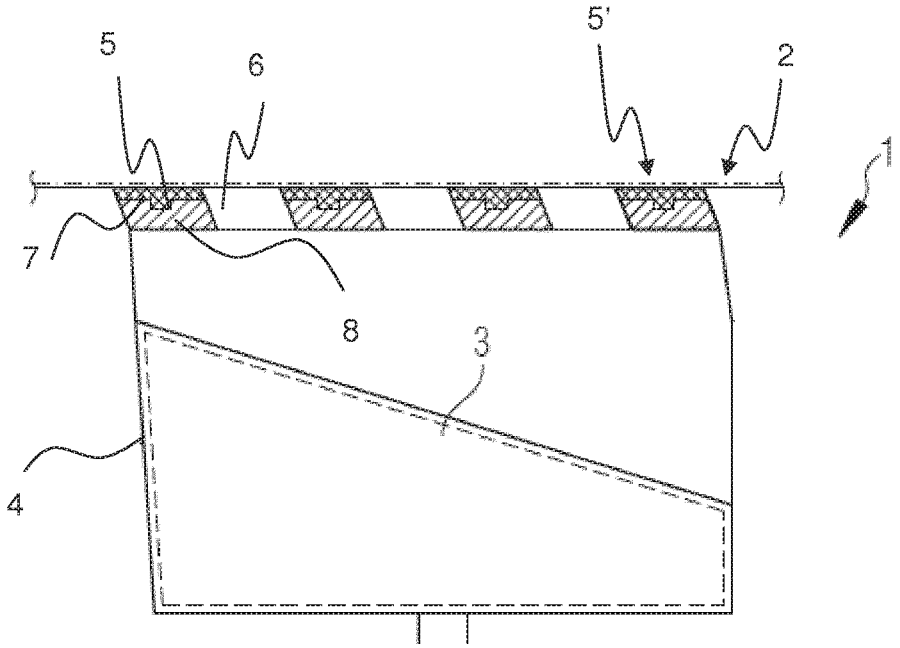
FIG. 2 shows a detailed view of the de-watering device from FIG. 1.

A detailed view of the de-watering device 1 from FIG. 1 is shown in FIG. 2. The de-watering device 1 can be a component part of the screen section 200 illustrated in FIG. 1 of the machine 100.

The de-watering device 1 comprises a box-shaped main body 4 which is optionally impingeable by a vacuum source 3 which is indicated in dashed lines and is preferably capable of being controlled in an open-loop/closed-loop manner. Said vacuum source 3 serves for improving the de-watering of the fibrous suspension, is assigned to the screen section 200, and is presently disposed within the main body 4.

A plurality of spaced-apart de-watering strips 5 which extend transversely to the machine direction L (arrow in FIG. 1) are disposed on the main body 4 on the upper side of the main body 4 that faces the lower side of the screen.

The de-watering strips 5 are mutually spaced apart when viewed in the machine direction L which corresponds to the running direction of the fibrous web to be produced in the machine. In the present case, said de-watering strips 5 are disposed so as to be mutually parallel in terms of the longitudinal axes thereof which transversely to the machine direction L run into the image plane.

Two directly neighboring de-watering strips 5, on the end sides thereof that face one another, conjointly delimit in each case one de-watering slot 6. When the de-watering strips 5 are disposed as illustrated in FIG. 2, said de-watering strips 5 in this instance conjointly preferably configure a flat de-watering face 5' which has a plurality of de-watering slots 6. Said de-watering face 5' runs so as to be substantially parallel to the screen revolving thereto, or so as to be substantially parallel to the fibrous web 2 to be produced thereon, respectively.

Each of the individual de-watering strips 5 comprises an upper part 7 that faces the screen, and a lower part 8 that faces the main body 4. Said lower part 8 is connected in a stationary manner to the main body 4.

Figure 3A:
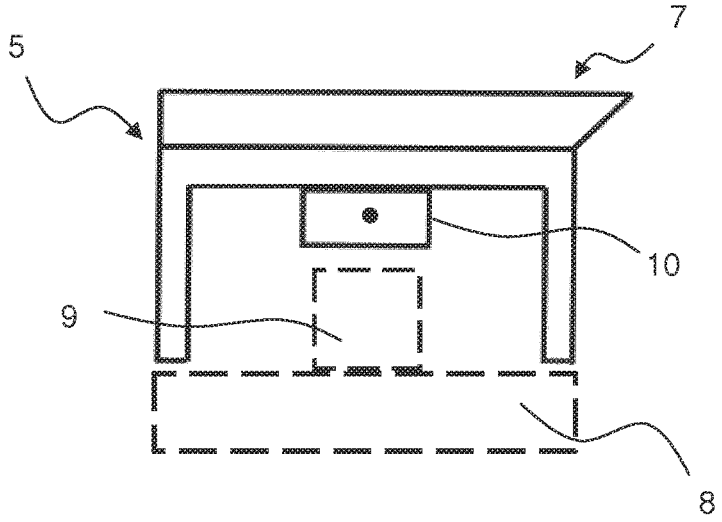
FIGS. 3*a* and 3*b* show a partially sectional illustration of an embodiment of the de-watering strip.
Figure 3B:
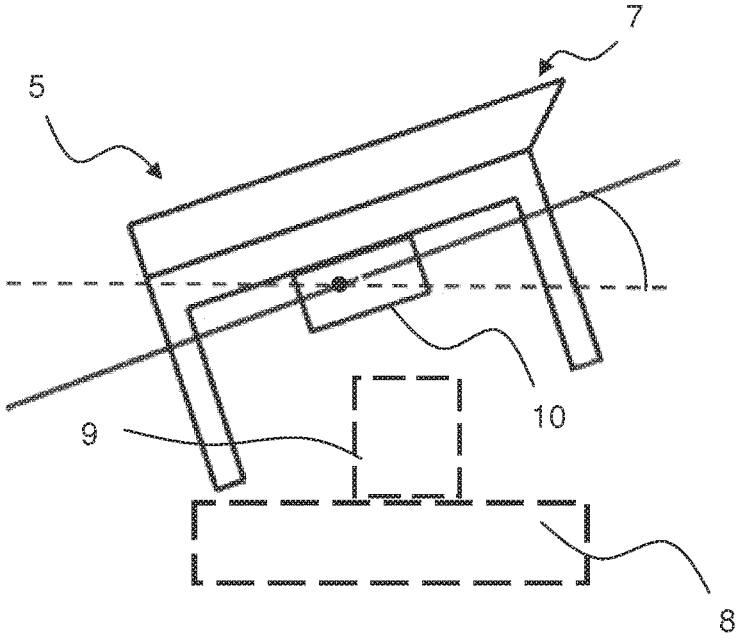

A cross section through the de-watering strip 5, perpendicular to the longitudinal axis of the latter, is in each case illustrated in FIGS. 3*a* and 3*b*. The upper part 7 is presently embodied in two parts. Said upper part 7 comprises a U-shaped first part on which a second part (also referred to as a wearing part) which faces the fibrous web is disposed. The second part can be releasably connectable to the first part so as to be replaceable in a destruction-free manner. The lower part 8 engages in the free opening which is delimited by the U of the upper part 7, as is indicated here by the dashed illustration.

Some or all of the de-watering strips 5 illustrated in the figures of the de-watering device 1 can be embodied so as to be pivotable. Said de-watering strips 5 can in this instance be in each case assigned one pivoting installation 9 so as to pivot the de-watering strip 5 relative to the main body 4 on which said de-watering strip 5 is assembled.

For example, such a pivoting installation 9 can be disposed within the de-watering strip 5, between the lower part 8 and the upper part 7. Said pivoting installation 9 can be completely encapsulated in relation to the ingress of media from the outside. The movable upper part 7 can thus be rotated or pivoted, respectively, relative to the fixed lower part 8 and thus relative to the main body 4 which is likewise connected in a stationary manner to the machine. The rotation axis about which the upper part 7 can be pivoted by means of the pivoting installation 9 is presently parallel to the longitudinal axis of the de-watering element 5 and thus transverse to the machine running direction. Said rotation axis as illustrated runs into the drawing plane and is indicated by a dot in the figures.

An inclination sensor 10 is disposed in that portion of the U that connects the two lateral legs of the upper part 7.

As is illustrated in FIG. 3*b*, the current inclination angle of the upper part 7, actually present on the respective de-watering strip(s) 5, in relation to a horizontal plane (illustrated in dashed lines) or the main body 4 can be detected directly by means of the inclination sensor 10. The inclination sensor 10 herein can be disposed within the upper part 7 in such a manner that said inclination sensor 10 detects the inclination angle of the upper part 7, preferably of the outer side of the upper part 7 that faces the lower side of the screen or the fibrous web, in relation to the horizontal plane.

Independently of the embodiment illustrated, the inclination sensor 10 can be embodied so as to be integral to the de-watering strip, here the upper part 7, or can be provided so as to be separate therefrom. In the last-mentioned case, said inclination sensor 10 is connected in a materially integral manner, a force-fitting manner and/or a form-fitting manner to the de-watering strip or the upper part 7, respectively.

Figure 3C:
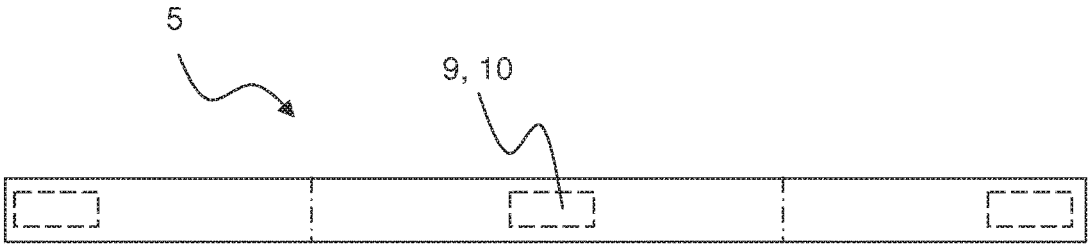
FIG. 3*c* shows a plan view of an embodiment of a de-watering strip.

A de-watering strip 5 across the entire length thereof is illustrated in a plan view perpendicular onto the fibrous web to be produced (not shown) in FIG. 3*c*.

The pivotally embodied de-watering strip 5, when viewed here across the length thereof, is even assigned a plurality of inclination sensors 10. It would be conceivable that the de-watering strip 5 along the length thereof (corresponds to the width direction of the fibrous web to be produced) is subdivided into a plurality of portions. This is indicated by the chain-dotted lines. Each portion could thus be assigned a separate pivoting installation 9 as well as a separate inclination sensor 10. On account thereof, the individual portions of a single de-watering strip 5 can assume another inclination angle in a mutually independent manner.

Independently of the embodiment illustrated, the inclination sensors 10 can be disposed within the respective de-watering strip 5, for example within the space delimited by the upper part 7 and the lower part 8. Said inclination sensors 10 can likewise be sealed or encapsulated, respectively, in relation to the ingress of media from the outside.

Figure 4:
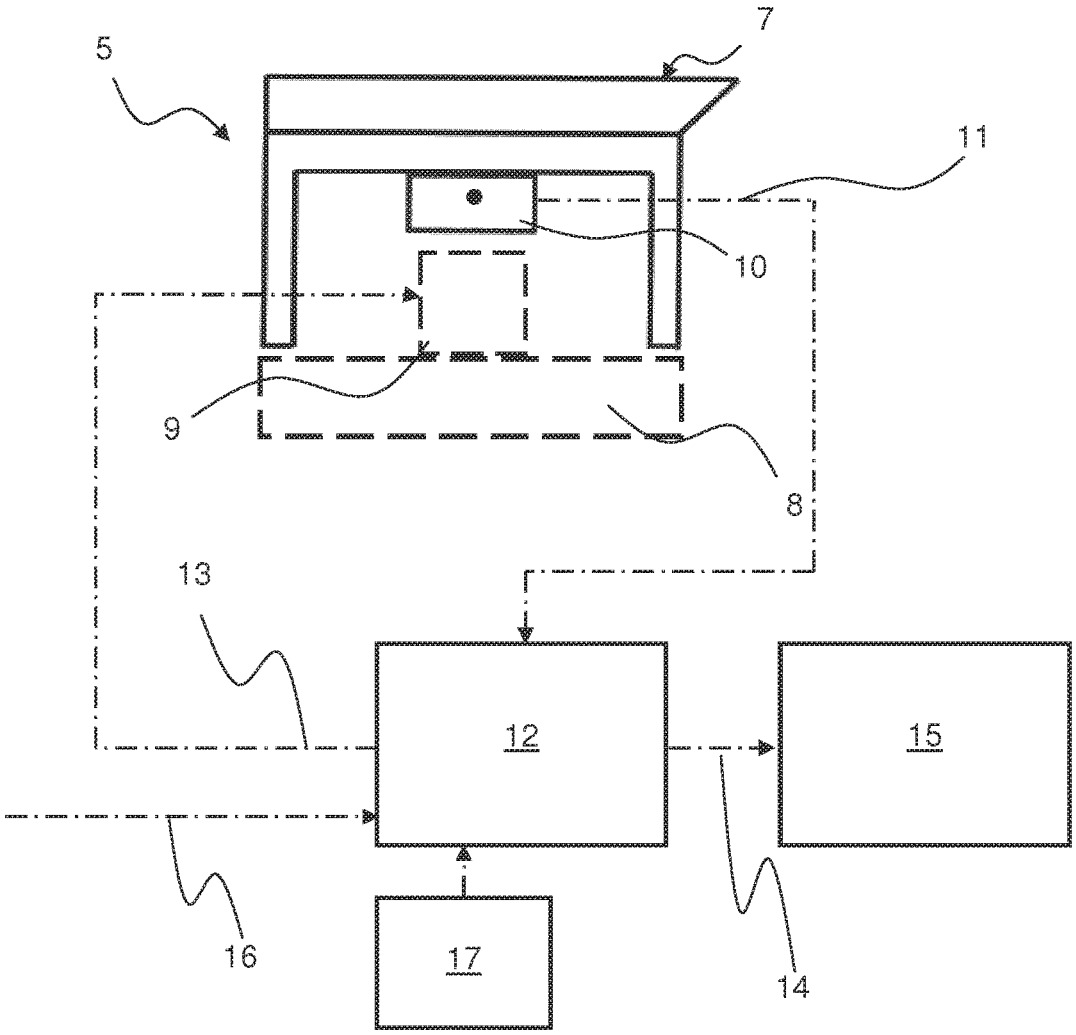
FIG. 4 shows a schematic illustration of a control diagram for a machine.

A circuit diagram for the closed-loop control of the inclination angle of the de-watering device 1 according to the invention, which is part of the machine 100 according to the invention, is shown in FIG. 4. Only one de-watering strip 5 is illustrated. However, this circuit diagram is also applicable to the remaining de-watering strips 5 of the de-watering device 1.

The inclination sensor 10 of a respective de-watering strip 5 is connected to a control installation 12 by way of a first communication channel 11, so as to transmit the actual inclination angle of the de-watching strip 5 to the control installation 12. Furthermore, the control installation 12, for setting the inclination of the de-watching strip 5, is connected to the pivoting installation 9 of the de-watering strip 5 by way of a second communication channel 13. The control installation 12 can thus address the pivoting installation 9 by way of the second communication channel 13 so as to set a specific inclination angle. The control installation is presently connected to a display installation 15 by way of a third communication channel 14, so as to graphically display the inclination angle/angles of one or a plurality of dewatering strips 5, for example.

The control installation 12 can be connected to the control system of the machine 100 by way of a fourth communication channel 16. Current method parameters of the machine such as, for example the energy requirement of the latter or the machine speed as well as properties of the fibrous suspension or of the fibrous web produced therefrom, such as the raw materials or the fabric density of said fibrous web, are transmitted as a predetermined variable to the control installation 12 by way of said fourth communication channel 16.

The control installation 12 can furthermore be assigned a memory 17 in which constant values, for example the types of fibrous webs that are producible on the machine, are stored in the form of a database, for example.

Only a single control installation 12 can be provided herein for all pivotably embodied dewatering strips 5. Respective communication channels 11, 13 are provided for each de-watering strip 5 connected to said control installation 12.

Figure 5:
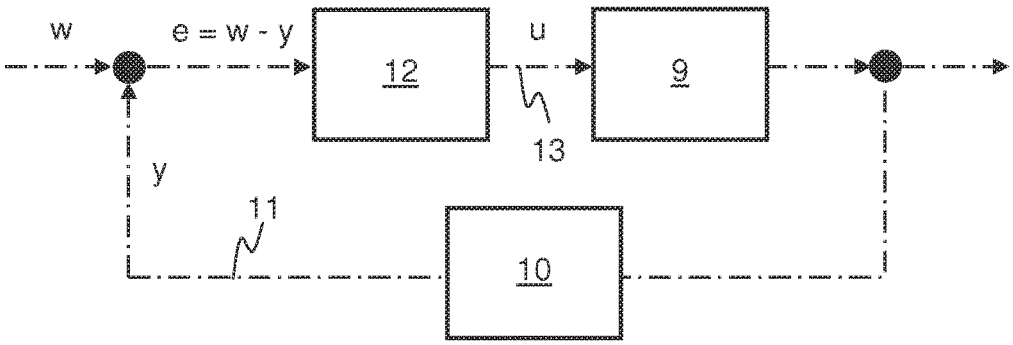
FIG. 5 shows a closed-loop control circuit for the closed-loop control of the inclination angle of at least one de-watering strip.

The closed-loop control of the inclination angle is now to be explained in more detail by means of the closed-loop control circuit illustrated in FIG. 5.

The inclination angle as a function of at least one parameter is now to be set in a corresponding manner, specifically as a function of the currently fed back inclination angle of the respective de-watching strip 5.

To this end, a nominal value w for the inclination angle to be set is first predefined by the control installation 12. The nominal value w can be predetermined as a function of a constant value at the beginning of the production process of the fibrous web, for example. To this end, the control installation 12 in the present case checks the memory 17 as to which fibrous web type is to be currently produced, for example. By way of this item of information, the control installation 12 determines the initial inclination angle (also referred to as the reference value) which the respective de-watching strip 5 is to assume at the beginning of the fibrous web production. This corresponds to a rough closed-loop control of the inclination angle.

Furthermore, the current, actually set inclination angle of the de-watering strip 5 is detected by means of the inclination sensor 10 and as the actual value y is likewise transmitted to the control installation 12. The latter forms a system deviation e from the nominal value w and the actual value y of the inclination angle. The control installation 12 from said system deviation e determines a corresponding input variable u by way of which said control installation 12 addresses the pivoting installation 9 so as to set the inclination angle so as to correspond to the system deviation e.

Once the machine 100 is operationally ready, said machine can be set in operation and de-water the fibrous web by means of the de-watering device, the de-watering strips of the latter being inclined to the pre-set reference value.

The rough closed-loop control can also be followed or superimposed by a fine closed-loop control of the inclination angle. To this end, the closed-loop control circuit is performed once again, as has been described at the outset. However, another parameter, specifically a method parameter for the closed-loop control which is typically modified in the operation is now resorted to for the fine closed-loop control. Such a method parameter can be the current screen speed of the screen of the screen section 200.

The pre-set nominal value of the inclination angle used in the rough closed-loop control can be a valid reference value in the fine closed-loop control. Proceeding from said reference value, the nominal value can then be modified (increased or decreased) in the fine closed-loop control so as to correspond to the method parameter.

In the operation, the reference value is then resorted to as the base value for the further closed-loop control, thus for the fine closed-loop control. The nominal value (based on the method parameter) determined for the fine closed-loop control herein is compared with the reference value by the control installation 12. The determined nominal value is set when the determined nominal value of the fine closed-loop control deviates from the reference value. However, this applies only as long as the determined nominal value of the fine closed-loop control does not exceed a range about the reference value. The range about the reference value is the limited by a maximum value which is larger than the reference value, on the one hand, and by a minimum value which is smaller than the reference value, on the other hand. As long as the nominal value as a function of the method parameter thus lies within said range, said nominal value is thus set to the actually calculated nominal value. However, as soon as said nominal value lies outside the range defined by the minimum value and the maximum value, the respective minimum value or maximum value, respectively, is set. For example, it is conceivable that the maximum value is at most 150% and the minimum value is at most 50% of the reference value.

In principle, it would be conceivable for the rough closed-loop control to be dispensed with and only the fine closed-loop control to be used for the closed-loop control. Conversely, it would also be possible for only the rough closed-loop control to be carried out at the start of the operation, and the fine closed-loop control to be dispensed with, such that the set inclination angle would remain correspondingly fixedly set in the operation.

In principle, the closed-loop control can continue until the effective setting of the inclination angle, thus the actually present inclination angle of the respective de-watering strip 5, is established by the control installation 12 by way of the first communication channel 11.

Independently of the embodiments illustrated, it would in principle be conceivable that the respective pivoting installation 9 of the pivotably embodied de-watering strips 5 could also be specified in such a manner that said pivoting installation 9 in addition to the pivoting movement also enables an axial movement of the upper part 7 relative to the lower part 8 in a direction of a vertical onto the fibrous web. Besides the inclination angle, the height of the upper part 7 in relation to the lower part 8, or to the main body 4, respectively could thus also be set.

The invention offers the advantage that in machines in which the operating conditions often change, a respective modification of the mentioned inclination angle at the de-watering strips is implementable in a simple and rapid manner in the running operation of the machine. Moreover, the efficiency of the de-watering can be increased as a function of the prevailing circumstances of the machine or of the fibrous web to be produced.

The invention claimed is:

1. A method of operating a machine for producing a fibrous web, the machine having a de-watering device with a plurality of pivotally mounted de-watering strips, the method comprising:

providing a pivoting installation configured to pivot the de-watering strips;

activating the pivoting installation by a control installation to thereby modify an inclination angle of at least one of the de-watering strips as a function of at least one parameter;

directly detecting, with an inclination sensor, an actual inclination angle of the at least one de-watering strip to be pivoted and transmitting the actual inclination angle to the control installation; and activating the pivoting installation with the control installation as a function of the actual inclination angle transmitted to the control installation.

2. The method according to claim 1, wherein the step of modifying the inclination angle comprises:

determining a setpoint value for the inclination angle by the control installation as a function of the parameter, the detected actual inclination angle corresponding to an actual value of the inclination angle;

determining a system deviation by the control installation from the setpoint value and the actual value of the inclination angle; and transmitting the system deviation as an input variable to the pivoting installation.

3. The method according to claim 1, wherein the at least one parameter is a constant value which describes a property of the fibrous web to be produced or a property of the machine per se, and the constant value is stored in the control installation or a memory assigned to the control installation.

4. The method according to claim 3, wherein the property of the fibrous web to be produced is a raw material or a type of the fibrous web, and the property of the machine is a construction mode of the machine or a calculated theoretical machine speed of the machine which is required for producing the fibrous web.

5. The method according to claim 3, which comprises determining the setpoint value of the inclination angle of the de-watering strip at a start of the operation as a function of the constant value.

6. The method according to claim 3, which comprises determining the setpoint value of the inclination angle of the de-watering strip during a further operation of the machine as a function of the process parameter.

7. The method according to claim 3, which comprises defining a nominal value of the inclination angle that at the start of the operation has been determined as a function of the constant value as a reference value for a further operation of the machine for further closed-loop controlling, and modifying the nominal value to a nominal value that is determined as a function of the process parameter.

8. The method according to claim 7, which comprises assigning the reference value a range with a minimum value and a maximum value, and modifying the nominal value that is determined as a function of the method parameter, proceeding from the reference value, only within the maximum value and the minimum value.

9. The method according to claim 8, wherein the maximum value is at most 150% and the minimum value is at most 50% of the reference value.

10. The method according to claim 1, wherein the at least one parameter is a process parameter that is measured or determined during an operation of the machine and that describes a current property of the fibrous suspension, of the fibrous web being produced, or an actually established variable of the machine.

11. The method according to claim 10, wherein the process parameter that describes the current property of the fibrous web being produced is an actually established fabric density of the fibrous web or a current dry content of the fibrous web, and the actually established variable of the machine is an actual machine speed of the machine at which the fibrous web is currently being produced.

12. The method according to claim 1, wherein the inclination angle of the de-watering strips is in relation to a horizontal plane and the actual inclination sensor detects a combination of inclination angles about a plurality of x, y, or z axes.

13. A machine for producing a fibrous web, the machine comprising:

a de-watering device having a plurality of pivotally mounted de-watering strips;

at least one pivoting installation assigned to de-watering device for pivoting at least one of said de-watering strips; and a control installation connected to said pivoting installation and configured to carry out the method according to claim 1.

* * * * *